US006099278A

United States Patent [19]

Hugenroth et al.

[11] Patent Number: 6,099,278

[45] Date of Patent: Aug. 8, 2000

[54] CANTILEVER MOUNT ORBITING SCROLL WITH SHAFT ADJUSTMENT

[75] Inventors: Jason J. Hugenroth; Thomas R. Barito, both of Arkadelphia, Ark.

[73] Assignee: Scroll Technologies, Arkadelphia, Ark.

[21] Appl. No.: 09/151,118

[22] Filed: Sep. 10, 1998

[51] Int. Cl.[7] ..... F01C 1/02

[52] U.S. Cl. ..... 418/55.1; 418/1; 384/299; 384/297; 384/910; 384/907.1

[58] Field of Search ..... 418/55.1, 1; 384/299, 384/297, 910, 907.1

[56] References Cited

U.S. PATENT DOCUMENTS

| | | | |
|---|---|---|---|
| 5,236,784 | 8/1993 | Kobayashi et al. | 384/907.1 |
| 5,256,042 | 10/1993 | McCullough et al. | 418/1 |
| 5,306,126 | 4/1994 | Richardson, Jr. | 418/1 |
| 5,308,231 | 5/1994 | Bookbinder et al. | 418/55.6 |

FOREIGN PATENT DOCUMENTS

| | | | |
|---|---|---|---|
| 176812 | 7/1989 | Japan | 384/907.1 |
| 404325787 | 11/1992 | Japan | 418/1 |

*Primary Examiner*—Thomas Denion
*Assistant Examiner*—Theresa Trieu
*Attorney, Agent, or Firm*—Howard & Howard

[57] ABSTRACT

A scroll compressor of the type having a cantilever mounted shaft is provided with a carbon crank case bearing. The carbon bearing insures that the shaft will be quickly worn away should there be shaft misalignment.

4 Claims, 4 Drawing Sheets

CANTILEVER MOUNT ORBITING SCROLL WITH SHAFT ADJUSTMENT

BACKGROUND OF THE INVENTION

The present invention relates to a scroll compressor wherein the orbiting scroll is cantilever mounted in a bearing, and the bearing is formed of a material such that it will cause wear to the shaft when the shaft is misaligned.

Scroll compressors are becoming widely utilized in many compression applications. Essentially, a scroll compressor includes a first member which orbits relative to a second member. Both members have a base and a generally spiral wrap extending from the bases. The two wraps interfit to define compression chambers. When the orbiting scroll orbits, the size of the chambers decreases to compress an entrapped refrigerant.

Scroll compressors are very popular because they are efficient. However, they present many design challenges in that there are a number of forces on the compressor components. One problem that occurs in the scroll compressor relates to the mounting of the shaft. A shaft drives the orbiting scroll through an electric motor. The shaft is mounted in an upper bearing and a lower bearing.

In the past, the upper and lower bearings have sometimes been misaligned. One type of scroll compressor shaft is cantilevered in the upper bearing. When bearing misalignment occurs with this type compressor, the shaft moves to an angle which is non-parallel to the central axis of the bearings. When this happens, there is contact between the edges of the upper bearing, and the outer surface of the shaft. There is then edge loading between the shaft and the bearing at the edges that are in contact. Seizure of the shaft can result, and there is also inadequate lubricant flow to the contact area.

Scroll compressors have sometimes utilized carbon containing bearings to mount the shaft. However, this type of bearing has only been utilized in a male mounted scroll compressor shaft, which does not have the cantilevered shaft. In this type of scroll compressor, there is no danger of edge loading.

SUMMARY OF THE INVENTION

In a disclosed embodiment of this invention, a shaft for driving an orbiting scroll extends through a bearing in a crank case. A portion of the shaft extends entirely through the bearing, and another portion of the shaft is mounted in a lower bearing. That is, the shaft is cantilevered in the upper bearing. The bearing mounted in the crank case contains hard carbon in a resin matrix. When shaft misalignment occurs, the bearing edges contact the shaft. However, rather than seizing as in the prior art, the bearing will cause removal of the material in the shaft at the area of the contact. Eventually, grooves will be formed in the shaft at the contact areas. The grooves prevent seizure and also insure adequate lubrication. The grooves also promote full-film hydrodynamic lubrication in the edge loaded region.

The same benefit would not occur in the prior art which has utilized these carbon bearings, in that those types of compressors did not have the problem.

These and other features of the present invention can be best understood from the following specification and drawings, the following of which is a brief description.

DETAILED DESCRIPTION OF A PREFERRED EMBODIMENT

Figure 1:
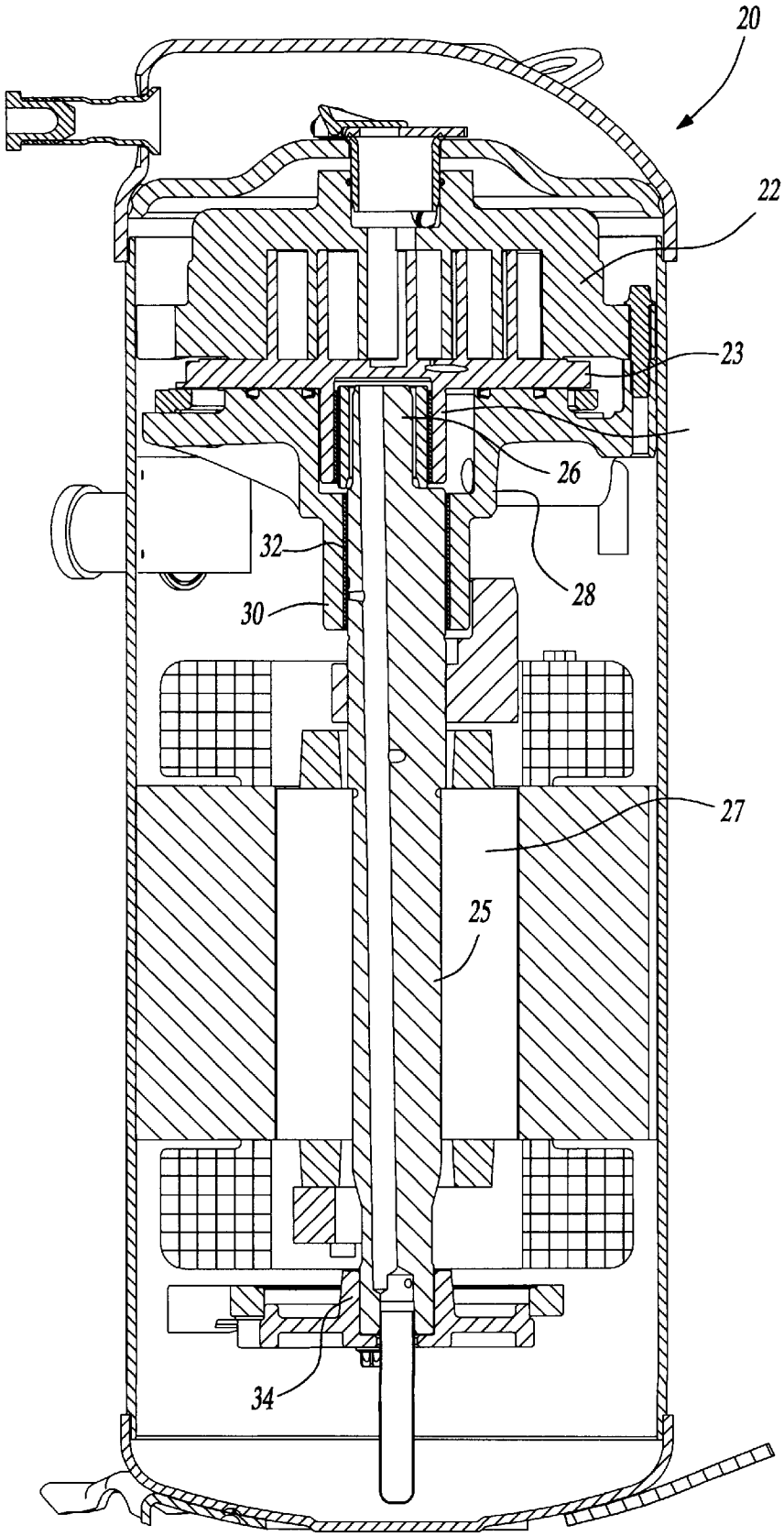
FIG. 1 is a cross-sectional view through an inventive scroll compressor of the type which benefits from the present invention.

A compressor 20 shown in FIG. 1 incorporates a fixed, or non-orbiting scroll member 22, and an orbiting scroll member 23. The orbiting scroll member 23 has a lower mount portion 24 received on a crank pin 26. As can be seen, the crank pin 26 has a smaller cross-sectional area than the remaining portion of the shaft 25. The crank pin 26 is associated with a shaft 25, which is driven by a motor 27. The shaft 25 is mounted in a crank case 28 at a bearing mount portion 30 by a bearing 32. The other end of the shaft 25 is mounted in a lower bearing 34. Notably, the compressor 20 is of the sort wherein the crank pin 26 on the shaft 25 extends through the bearing 32 and the crank case 28, and is thus cantilever mounted in the bearing 32.

Figure 2:
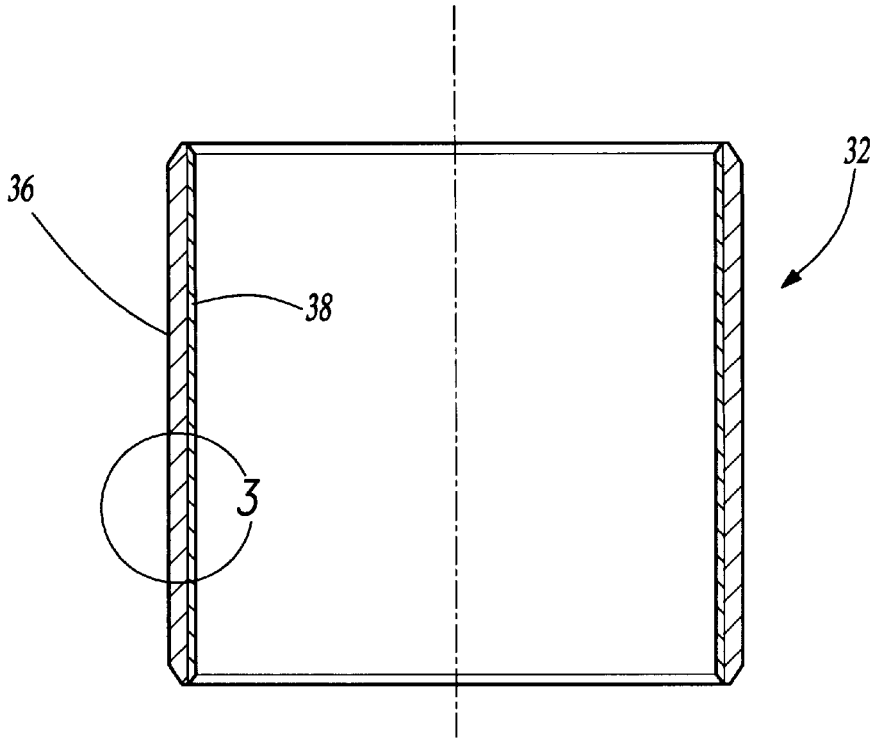
FIG. 2 is a cross-sectional view through an inventive bearing.

As shown in FIG. 2, the bearing 32 incorporates an outer liner portion 36 formed of a steel material, and an inner portion 38 formed of a composite resin material.

Figure 3:
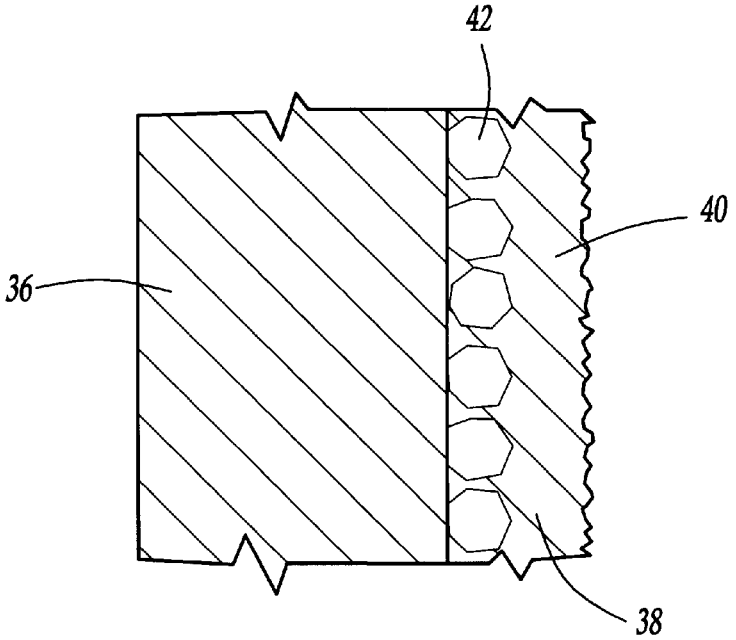
FIG. 3 is a cross-sectional view through the area shown by line 3 in FIG. 2.

As shown in FIG. 3, the composite material includes a graphite and heat resistance resin complex layer 40 incorporating a plurality of lead bronze porous sintering layer particles 42. The layer 40 includes hard carbon particles deposited into a resin base. The use of the graphite carbon composite bearing provides benefits which will be described below. The bearing is available from Taiho Kogyo, Ltd., under their trade name "Carbon Composite Bi-Metal Bearings CB100G."

In one embodiment, the steel backing 36 extended for 1.35 mm and the total thickness was 1.7 mm. Thus, the layer 38 is relatively thin compared to the layer 36.

The structure of the bearing forms no portion of this invention, it is the use of such a bearing in the particular application which is inventive.

Figure 4:
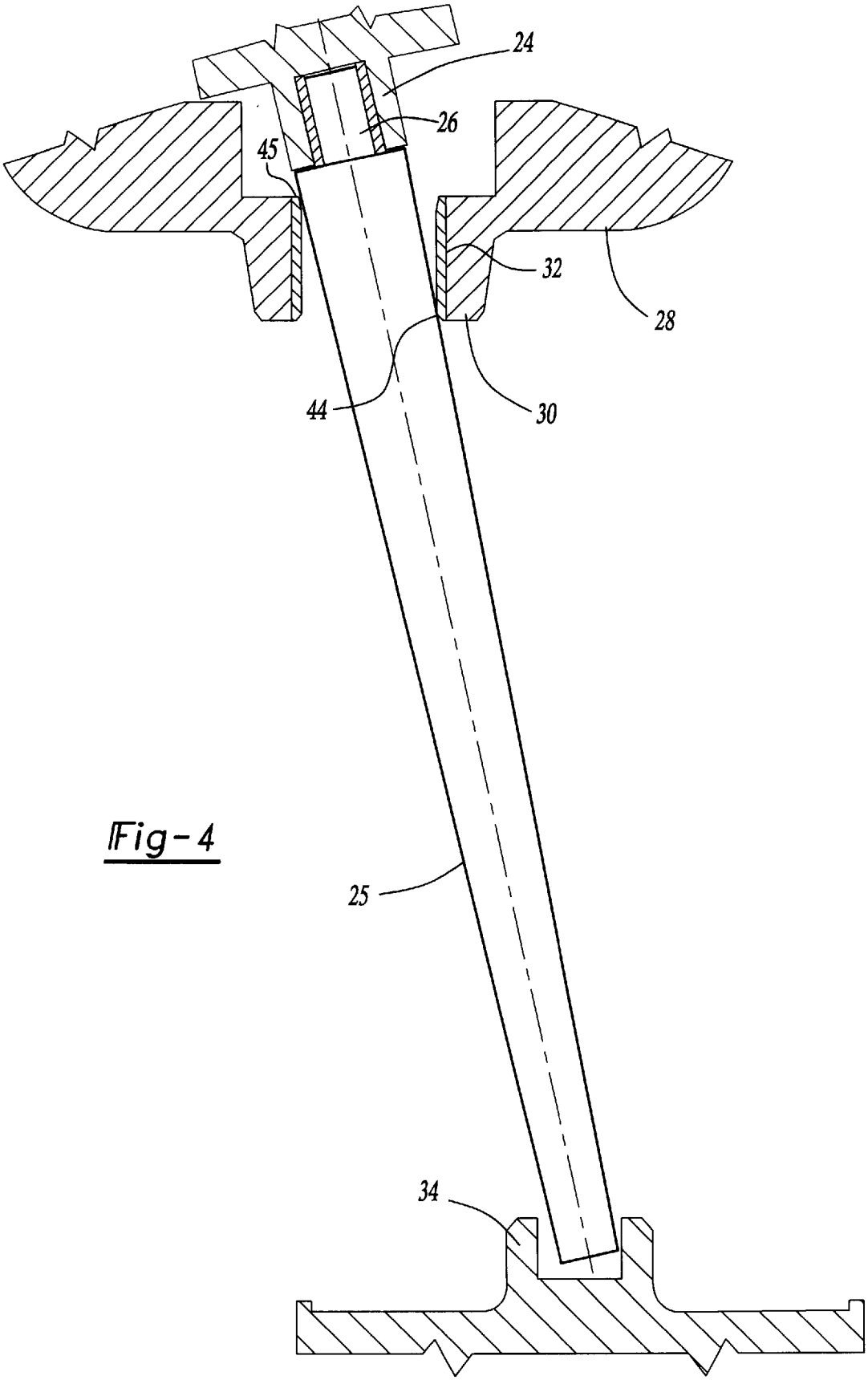
FIG. 4 shows a problem encountered by this type of compressor.

The problem to be addressed by this invention is shown for example in FIG. 4. As shown in FIG. 4, a central axis of the bearings 32 and 34 has been misaligned. This can happen during assembly of the compressor. The amount of misalignment is exaggerated in FIG. 4 to show the fact of misalignment.

When misalignment occurs, the cantilever mounted pin 26 extends beyond the bearing 32, and a contact edge point 44 exists between the bearing 32 and the shaft outer periphery 25. In addition, another contact edge point 45 is also created. In the prior art, this contact is sometimes led to seizing of the shaft, and will often result in adequate lubricant supply to the contact areas.

Figure 5:
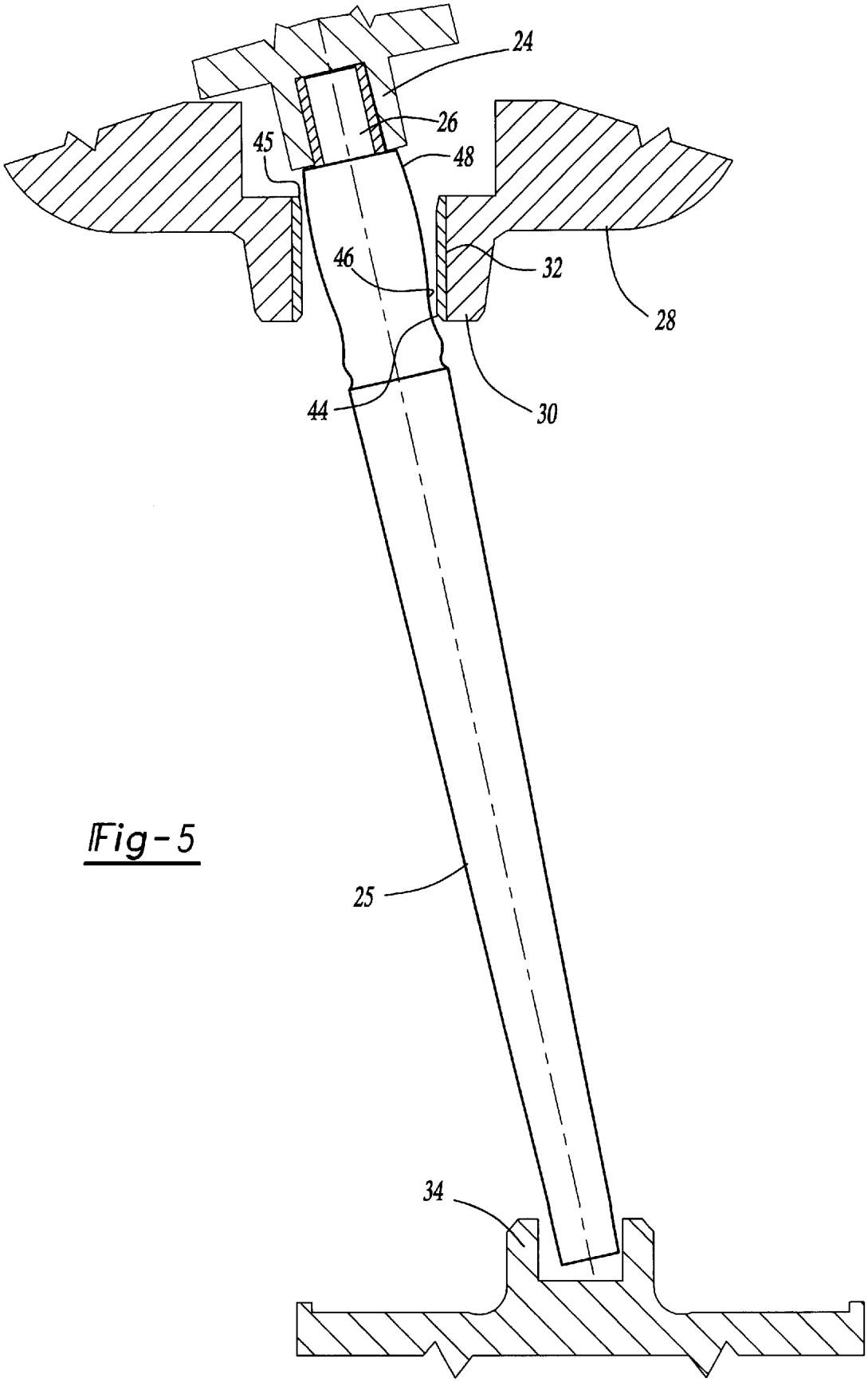
FIG. 5 shows the inventive bearing solving the FIG. 4 problem.

As shown in FIG. 5, the inventive compressor with the carbon particles embedded in the outer layer will instead result in the shaft being quickly worn away such as at 46 and 48 to prevent edge contact. This will ensure flow of lubricant between the shaft and the edges 44 and 45 of the bearing 32. Thus, the bearing material provides an unexpected benefit when utilized in a cantilever mounted scroll compressor. The prior art provided no such benefit, and included no such problem. Thus, the use of this type of bearing in the particular disclosed application provides unexpected benefits.

A preferred embodiment of this invention has been disclosed; however, a worker of ordinary skill in the art would recognize that certain modifications would come within the scope of this invention. For that reason the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from said base, said wraps of said first and second scroll members interfitting to define compression chambers, said first scroll member having a mount portion extending away from said second scroll member to receive a drive shaft;

a crank case mounted beneath said first scroll member, and on a side opposed from said second scroll member;

a shaft having a pin extending through said crank case, and into said mount portion of said first said scroll member, and an electric motor driving said shaft;

a first bearing mounted in said crank case and surrounding said shaft, said pin of said shaft extending through said first bearing and into said mount portion of said first scroll member;

a second bearing mounted at an opposed end of said shaft and on a remote side of said motor from said first bearing; and said first bearing having a material composition including carbon particles deposited into a resin.

2. A scroll compressor as recited in claim 1, wherein said material results in said shaft being worn away at edges of said first bearing should said shaft be misaligned in said first and second bearings.

3. A method of operating a scroll compressor comprising the steps of:

1) providing a scroll compressor including a first and second scroll member, each having a base and a generally spiral wrap extending from said base, said wraps of said first and second scroll members interfitting to define compression chambers, said first scroll member having a mount portion extending away from said second scroll member, a shaft including a mount pin extending into said mount portion of said first scroll member, said shaft mounted to be driven by an electric motor, said shaft being mounted at one end of said motor in a lower bearing, and said shaft having said mount pin extending into said mount portion of said first scroll member at an opposed end of said motor, a portion of said shaft intermediate said motor and said pin being mounted in an upper bearing in a crank case, said mount pin extending entirely through said upper bearing such that said mount pin is cantilever mounted within said upper bearing, and said upper bearing being formed of an outer metal portion and an inner portion including a carbon material deposited into a resin layer;

2) driving said first scroll member to orbit relative to said second member by driving said shaft with said electric motor; and 3) wearing portions of said shaft which are in contact with edges of said upper bearing should said upper bearing be misaligned relative to said lower bearing, said carbon material causing said shaft material to be quickly worn away.

4. A scroll compressor as recited in claim 1, wherein said pin has a smaller outer diameter than an outer diameter of said shaft.

* * * * *